United States Patent [19]

Gooch

[11] Patent Number: 4,860,477

[45] Date of Patent: Aug. 29, 1989

[54] STYROFOAM BALL ADVERTISING DISPLAY APPARATUS AND METHOD

[76] Inventor: William E. Gooch, Rte. 1, Box 37A, Mill Spring, Mo. 63952

[21] Appl. No.: 75,997

[22] Filed: Jul. 21, 1987

[51] Int. Cl.[4] ..... A47G 33/10

[52] U.S. Cl. ..... 40/603; 40/617; 63/13; 428/11

[58] Field of Search ..... 40/582, 603, 604, 613, 40/617, 623; 43/43.1, 44.9, 44.91; 63/13; 248/218.2; 403/209, 213; 428/7, 11

[56] References Cited

U.S. PATENT DOCUMENTS

| | | | |
|---|---|---|---|
| 718,708 | 1/1903 | Geiger | 63/13 |
| 1,791,175 | 2/1931 | Tomlinson | 428/11 X |
| 1,976,093 | 10/1934 | Raymond | 40/613 X |
| 2,854,942 | 10/1958 | Ross | 428/11 X |
| 3,030,718 | 4/1962 | Kirkman | 40/617 |
| 3,533,247 | 10/1970 | Douglas | 63/13 X |
| 3,533,890 | 10/1970 | Nesbit | 428/11 X |
| 3,757,442 | 9/1973 | Cook | 40/617 |
| 3,791,899 | 2/1974 | Walters | 428/11 X |

FOREIGN PATENT DOCUMENTS

| | | | |
|---|---|---|---|
| 1237279 | 3/1967 | Fed. Rep. of Germany | 428/11 |
| 488338 | 7/1938 | United Kingdom | 40/582 |
| 1027433 | 4/1966 | United Kingdom | 40/617 |
| 2078472 | 1/1982 | United Kingdom | 43/43.1 |

*Primary Examiner*—Robert G. Nilson

*Attorney, Agent, or Firm*—James Creighton Wray

[57] ABSTRACT

An advertising display includes a spherical styrofoam ball having a luminescent outer coating and means for hanging the sphere on a variety of supports. The supports may include automobile antennas and lines hung across billboards. The advertising system would include hanging a plurality of these spheres at spaced intervals on a line with wind generated motion providing means for attracting attention to the sign. Shapes other than spheres may be used. Another aspect of the invention is a method of manufacturing a display device which includes pushing a wire through a styrofoam sphere, bending an inerted end of the wire into a hook, and pulling the hooked inserted end back towards the sphere, thereby embedding the hook in the sphere. An opposite end of the wire is provided with a fishing line spinner for connecting the sphere to a support while providing a universal joint so that the sphere can freely rotate.

14 Claims, 2 Drawing Sheets

STYROFOAM BALL ADVERTISING DISPLAY APPARATUS AND METHOD

BACKGROUND OF THE INVENTION

The present invention relates to advertising display devices and methods.

In advertising, catching the attention of passers-by has been a persistent problem. Attention is required before any advertisement can be successful.

Lack of attention is particularly acute in the area of road signs and roadside businesses since motorists tend usually not to notice stationary objects other than to acknowledge the presence generally.

U.S. Pat. No. 3,757,442 shows a sponge rubber sphere 10 and a support hook 32 which is embedded in the sphere. However, the hook end is opposite the inserted end which is provided with a spike to retain the inserted end in the sphere.

U.S. Pat. No. 2,854,942 shows the concept of hanging a spherical display on a string. However, the display is not intended to move in response to wind. The patent describes an intended use as a position indicator for a car within a garage.

U.S. Pat. No. 3,445,551 shows a spherical ball having a phosphorescent material.

The following U.S. references are less pertinent than those listed above but tend to show other types of display or ornamental objects and means for hanging them:

4,214,390
1,791,175
1,141,317
366,612

None of the aforementioned references show display devices which can freely rotate by wind actuation, or which utilize the assembly techniques to be described herein.

SUMMARY OF THE INVENTION

The present invention comprises at least one styrofoam ball which is spherically shaped and hung on a string in a series with preferably any other balls. Brightly colored styrofoam balls attached to swivel and spinning joints would allow for free movement of the balls due to the low density of the styrofoam material. The swivel and spinning joints would be hooked on automobile antennas, nylon cords, tree limbs suction cups, etc., in order to bring attention to the particular display article. On highway signs, which commonly run 60 feet in length, braces or brackets could be provided on opposite sides of the sign to allow a string to be run from one side to the other. In one embodiment, the brackets could be braced or cantilevered over to hang in front of the sign at the top thereof. Preferably, the string would be supported about one foot from the sign. At intervals of approximately one foot, a plurality of styrofoam spherical balls would be hung by their spinning and swivel joints to let the wind actuate them. Movement and color entice the eyes of those passing by.

Preferably, the display apparatus would include a string about 60 feet long with spherical balls hung approximately every foot. However, variations in length and size and spacing may be adapted to particular needs.

A spherical ball hung on an automobile antenna can be used while the automobile is moving. The display ball would attract attention to the automobile as a novelty device.

Other geometric shapes include cubes, stars, hexagonal shapes, pyramidal shapes, etc.

An object of the invention is to provide an advertising display apparatus or decoration comprising at least one display body, a connector connected to at least one body for hanging the body on a display article or object, wherein an outer surface of the display body is coated with a conspicuous material.

Preferably, the display body is made of styrofoam and is spherically shaped.

In the preferred embodiment the connector comprises an anchor embedded in the body and an eyelet formed at one end of the anchor extending outwardly from the body.

An end of the anchor opposite the eyelet is hooked, wherein a U portion of the hook is disposed on a diametrically opposite side of the body from the eyelet.

Another object of the invention is to provide a spinning swivel joint having one end connected to the connector and the opposite end connectable to means for hanging the display body.

The spinning joint may be a fishing line spinner.

Another object is to provide hanging means for hanging the display body to a display article.

The hanging means may include a segment of fishing line or wire.

Another object is to provide a plurality of display bodies, each being connected in spaced relation to each other by the segment of fishing line to a long, substantially horizontal line extending between two supporting structures.

Another hanging means may be a staple.

The conspicuous coating material may be brightly colored fluorescent paint or colored glitter adhesively bonded to the surface of the body.

The outer surface of the body may instead be colored and the conspicuous material comprises small glass beads adhered to the surface by varnish.

Another object is to provide a method of manufacturing a display apparatus comprising, bending a length of wire at one end to form an eyelet, pushing the opposite end of the wire through a display body made of styrofoam material or material of similar physical characteristics, bending the inserted end to form a hook, pushing the hook into the display body, and connecting the eyelet to a display article.

Preferably, prior to connecting the eyelet to a display article, a spinning swivel joint is connected at one end to the eyelet and at the other end of a display article.

The method may include hanging a line from opposite ends thereof and connecting the spinning swivel joint to the line, and coating the display body with conspicuous material.

Another aspect of the invention is to create an item of decorative jewelry known as earrings in which the previously described methods and apparatuses would be used in the context of hanging a display article, in this case an earring, from an individual'ear. The method of forming or manufacturing the earring would be substantially similar in that styrofoam or styrofoam-like material, in appropriate shapes, preferably spherically shaped, would be pierced by a wire which would be bent on the piercing end and then re-inserted into the ball to provide an anchor. Instead of the fishing line spinner previously described, or in addition thereto, a connector suitable for connecting to an individual's ear would be used. The connector could be of a type suitable for pierced ears, or could be of the type known as the pinch type which lightly pinches the lobe of the wearer. In the case of earrings, the styrofoam bodies would be smaller and could hang from varying lengths of connector. The preferred earrings would include the swivel and spinning joint to provide the same effect as previously described.

DETAILED DESCRIPTION OF THE DRAWINGS

Figure 1:
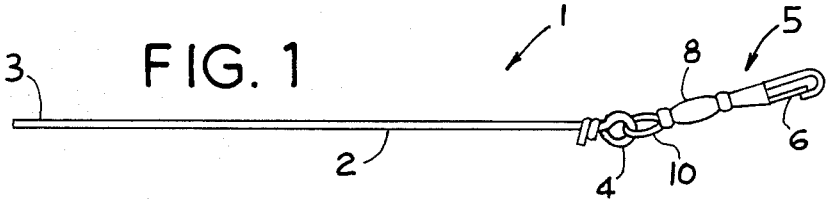
FIG. 1 is a side elevation view of the preferred connector and spinning joint used in the display apparatus.

Referring now to FIGS. 1 through 4, and specifically now referring to FIG. 1, a connector 1 is made of a length of wire 2 having one end 3 which is initially straight and an opposite end which is bent into an eyelet 4. The eyelet 4 is used to connect a spinning joint 5 at the spinning joint eyelet 10. Opposite the eyelet 10, the spinning joint has a clasp fastener 6 which is used to connect the spinning joint to a display article, such as a billboard. In the preferred embodiment, the clasp 6 would attach to the display article through a hanging line. The spinning joint has a spinning mid-section 8 which is of known construction. In fact, the spinning joint, generally referred to by the numeral 5, is preferably a known device which is used in the art of fishing and is known as a fishing line spinner.

Figure 2:
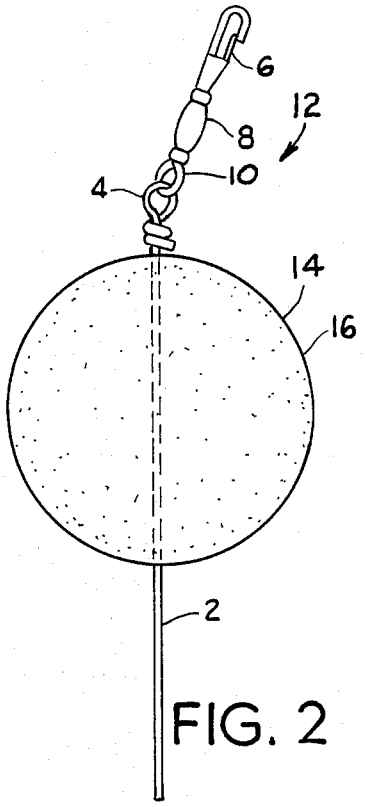
FIGS. 2, 3 and 4 show in sequence formation of a preferred display apparatus using the connector and spinning joint of FIG. 1.

When the straight end 3 of the wire 2 is pushed through a display body 14, as shown in FIG. 2, a display apparatus 12 is formed. In the embodiment shown in FIGS. 2 through 4, the display body 14 is spherically shaped and is made of styrofoam material. The outer surface 16 of the spherical body 14 is preferably coated with a fluorescent material such as a fluorescent paint. However, it is preferred to coat the spherical body before insertion of the wire connector.

Figure 3:
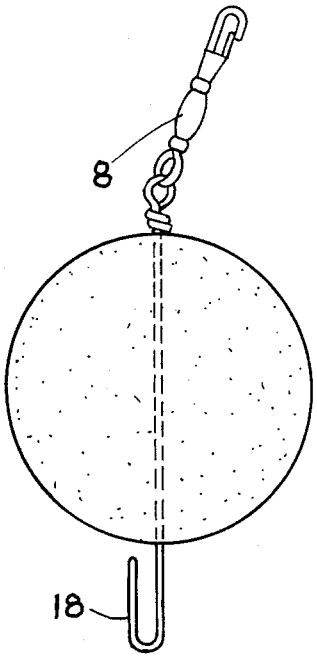
Figure 4:
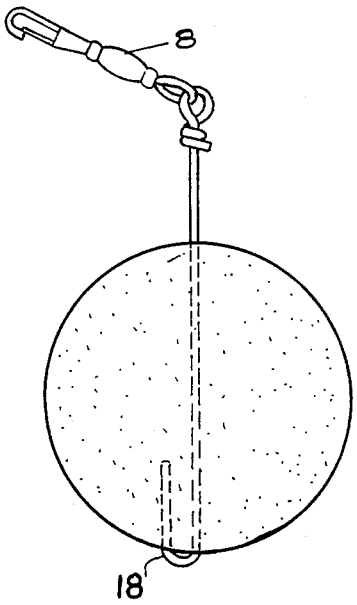

Referring to FIG. 3, after the wire is inserted, as shown in FIG. 2, a hook 18 is bent into the end of the wire. In FIG. 4, it is shown that the hook 18 is then pulled back into the spherical body thereby forming a good connection. The inserted portion and the hook generally constitute an anchor for the eyelet 8 which can be used to connect the spherical body to a display article directly or through a spinning joint 5.

Figure 5:
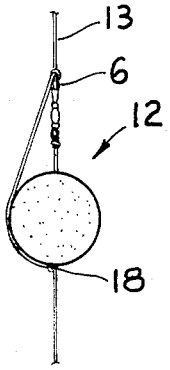
FIGS. 5 and 6 show alternative ways to attach the display apparatus to hanging lines.

Referring to FIG. 5, the display apparatus 12 may be connected to a hanging line 13 by hooking the clasp 6 to the line and also through the hook 18 at the opposite end of the spherical body.

It should be understood that the connection to line 13 can be done with numerous display apparatuses to form a series of balls which move, because of the low density of the styrofoam material, in response to the wind. Movement of the styrofoam balls attracts attention of passers-by to the display article, such as a billboard or a car parked on a lot or a Christmas tree.

Figure 6:
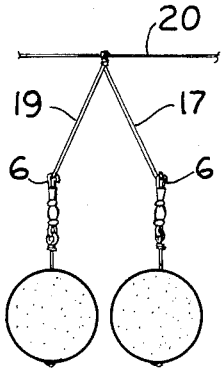

In FIG. 6, a dipslay line 20 is used to hang two display apparatuses by separate lines 17, 19 which are joined together or converged at the line 20. In this type of connection, the close proximity of the two spherical bodies will create more movement by the spherical bodies bouncing off each other in response to the wind.

Figure 7:
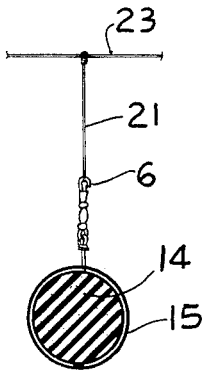
FIG. 7 shows another technique for hanging the display apparatus and also shows the display body in cross section.

In FIG. 7, a line 23 is used to hang a display apparatus from a segment of line 21. The spherical body 14 is shown in cross section, with a coating 15 of fluorescent or otherwise conspicuous material. For instance, the coating 15 can constitute a layer of fluorescent paint which should be brightly colored, as red, yellow, green, etc. In the alternative, the coating 15 could be applied to a colored styrofoam or similar body which could be dipped or otherwise coated with varnish, such as SPAR Varnish. While the varnish is still tacky, the balls could be rolled in colored glass beads such that the beads would adhere to the outer surface of the spherical body.

The coatings and connections described above could be applied to objects of other shapes, although the spherical shape is preferred. Regardless of the shape, the spinning joint will allow the display body to rotate freely and rotating the body, with fluorescent, luminescent, or reflecting material applied thereto, will enhance the visibility of the display apparatus and therefore the display article associated with the display apparatus.

Figure 8:
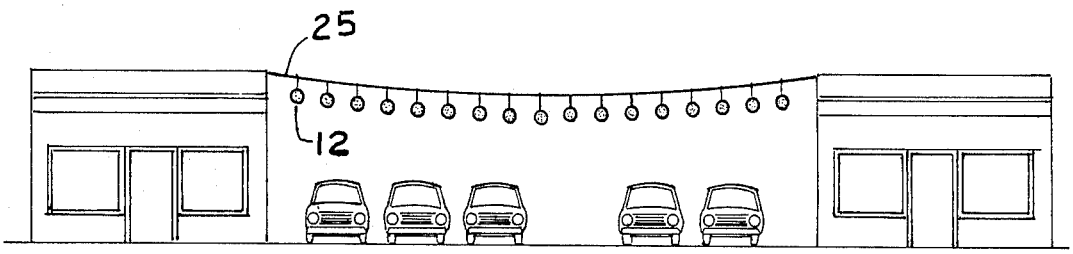
FIG. 8 is a side elevation of the display apparatus in use.

In FIG. 8, a use of the display apparatus is shown where a series of display apparatuses 12 are hung from a line 25 which extends between two structures.

Figure 9:
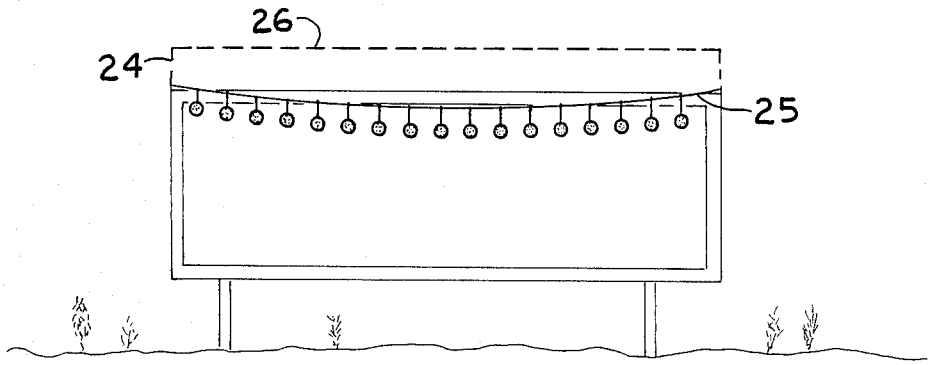
FIG. 9 is a side elevation of the display apparatus in an alternative use.

An alternative is shown in FIG. 9 wherein the hanging line 25 extends from one side of a billboard to another. Alternatively, brackets or supports 22, 24, extend upwardly from opposite sides of the billboard and a line 26 could extend between the two supports. This is preferred so that the display bodies would hang above the sign or billboard.

Figure 10:
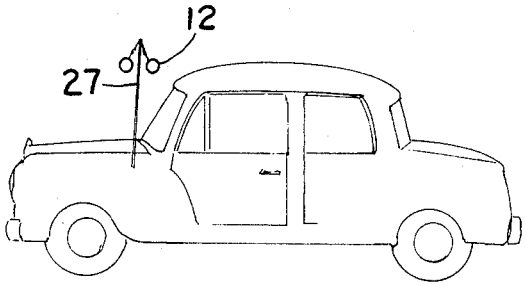
FIG. 10 is a side elevation view of the display apparatus in another alternative use.

In FIG. 10, an automobile is shown with an antenna 27 to which a display apparatus 12 could be attached, or a pair could be attached. In either event, the dipslay apparatus would spin freely and the motion of the display apparatus would attract attention to the display article, i.e., the car.

Figure 11:
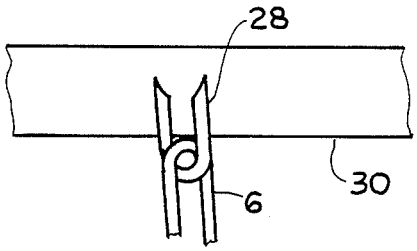
FIG. 11 is a cross-sectional view, in detail, of another hanging technique.

In FIG. 11, an alternative attachment or hanging means is disclosed wherein a staple 28 is used to connect the display apparatus directly by means of the clasp 6 to a ceiling 30 or other structure into which the staple 28 could be driven. Because the clasp 6 has a spring biased latch, the staple 28 could be driven into the ceiling or other structure first and then the clasp could be opened to allow attachment and then closed to ensure the attachment.

Some of the spheres or otherwise shaped bodies could be covered with colored glitter material. Glitter is readily available and can be purchased from most art supply stores. Some could be covered with glitter while others could simply be colored and then dipped in SPAR Varnish. After dipping, and while the varnish is tacky, the balls could be rolled in small glass beads to make them reflective to light. This could be effective at night and particularly on signs using 3M reflective sheeting that is lit by automobile headlights as they pass by.

The display apparatus described herein is particularly useful for stores and restaurants. In particular, the staple described in FIG. 11 could be used by driving the stable into the ceiling or around the eaves of the outside of the building in order to attach the spinning joint of the ball or sphere.

In the context of billboards and other road signs, it would be best to use a string of balls across the sign, as shown in FIG. 9. It is preferred to string the balls above the sign, as shown in broken lines in the figure.

On automobile lots, it would be preferable to hang a string of balls from pole to pole above the lots. Also, antennas could be used to display one or two balls, as shown in FIG. 10. In showrooms of automobile dealers, the balls could be hung from ceilings with staples, as described previously.

I claim:

1. An advertising display apparatus comprising at least one display body, a connector connected to at least one body for hanging the body on a display article, wherein an outer surface of the display body is coated with a conspicuous material, wherein the display body is made of styrofoam, wherein the connector comprises an anchor embedded in the body and an eyelet at one end of the anchor extending outwardly from the body, wherein an end of the anchor opposite the eyelet is hooked, wherein a U portion of the hook is disposed on a diametrically opposite side of the body from the eyelet, and wherein a free leg of the U portion is embedded in the body parallel to a leg of the anchor.

2. The appartus of claim 1 wherein the body is spherically shaped.

3. The apparatus of claim 1 further comprising a spinning swivel joint having one end connected to the connector and the opposite end connectable to means for hanging the display body.

4. The apparatus of claim 3 wherein the spinning joint is a fishing line spinner.

5. The apparatus of claim 3 further comprising hanging means for hanging the dipslay body to a display article.

6. The appartus of claim 5 wherein the hanging means comprises a segment of fishing line.

7. The apparatus of claim 6 further comprising plural display bodies, each being connected in spaced relation to each other by the segment of fishing line to a long, substantially horizontal line extending between two supporting structures.

8. The apparatus of claim 5 wherein the hanging means compries a staple.

9. The apparatus of claim 1 wherein the conspicuous coating material comprises brightly colored fluorescent paint.

10. The apparatus of claim 1 wherein the conspicuous material comprises colored glitter adhesively bonded to the surface of the body.

11. The apparatus of claim 1 wherein the outer surface of the body is colored and the conspicuous material comprises small glass beads adhered to the surface by varnish.

12. The apparatus of claim 1, wherein a free leg of the U portion is longer than the U portion is wide.

13. The apparatus of claim 12, wherein the free leg of the U portion is more than twice as long as the U portion is wide.

14. The apparatus of claim 13, wherein a length of the free leg of the U portion is approximately one quarter of a thickness of the body in which the anchor is embedded.

* * * * *